United States Patent [19]

McKibbin

[11] Patent Number: 4,570,749

[45] Date of Patent: Feb. 18, 1986

[54] SUSPENDED SCAFFOLD

[75] Inventor: John R. McKibbin, Birmingham, Ala.

[73] Assignee: Mason Corporation, Birmingham, Ala.

[21] Appl. No.: 700,802

[22] Filed: Feb. 11, 1985

[51] Int. Cl.[4] ..... E04G 3/16

[52] U.S. Cl. ..... 182/36; 182/150

[58] Field of Search ..... 182/36, 37, 38, 150

[56] References Cited

U.S. PATENT DOCUMENTS

| | | | |
|---|---|---|---|
| 1,392,820 | 10/1921 | Davis | 182/36 |
| 1,743,100 | 1/1930 | Blackburn | 182/36 |
| 2,761,396 | 9/1956 | Harlan | 182/36 |
| 2,925,240 | 2/1960 | Laviolette | 182/36 |
| 2,985,253 | 5/1961 | Hollingsworth | 182/36 |
| 3,735,951 | 5/1973 | Reed | 182/150 |
| 3,945,462 | 3/1976 | Griswold | 182/113 |

FOREIGN PATENT DOCUMENTS

| | | | |
|---|---|---|---|
| 355599 | 8/1961 | Switzerland | 182/36 |

*Primary Examiner*—Reinaldo P. Machado

*Attorney, Agent, or Firm*—Woodford R. Thompson, Jr.

[57] ABSTRACT

A portable suspended scaffold utilizes a carriage having circumferentially grooved rollers which engage upturned flanges on a set of purlins. A suspension structure depends from the carriage such that workers may affix overhead fixtures such as roof panels to the purlins above the scaffold. The scaffold utilizes a plurality of platform elements which are removably carried by the suspension structure such that the scaffold may be manually propelled along the length of the purlin without having the workers thereon dismount.

5 Claims, 5 Drawing Figures

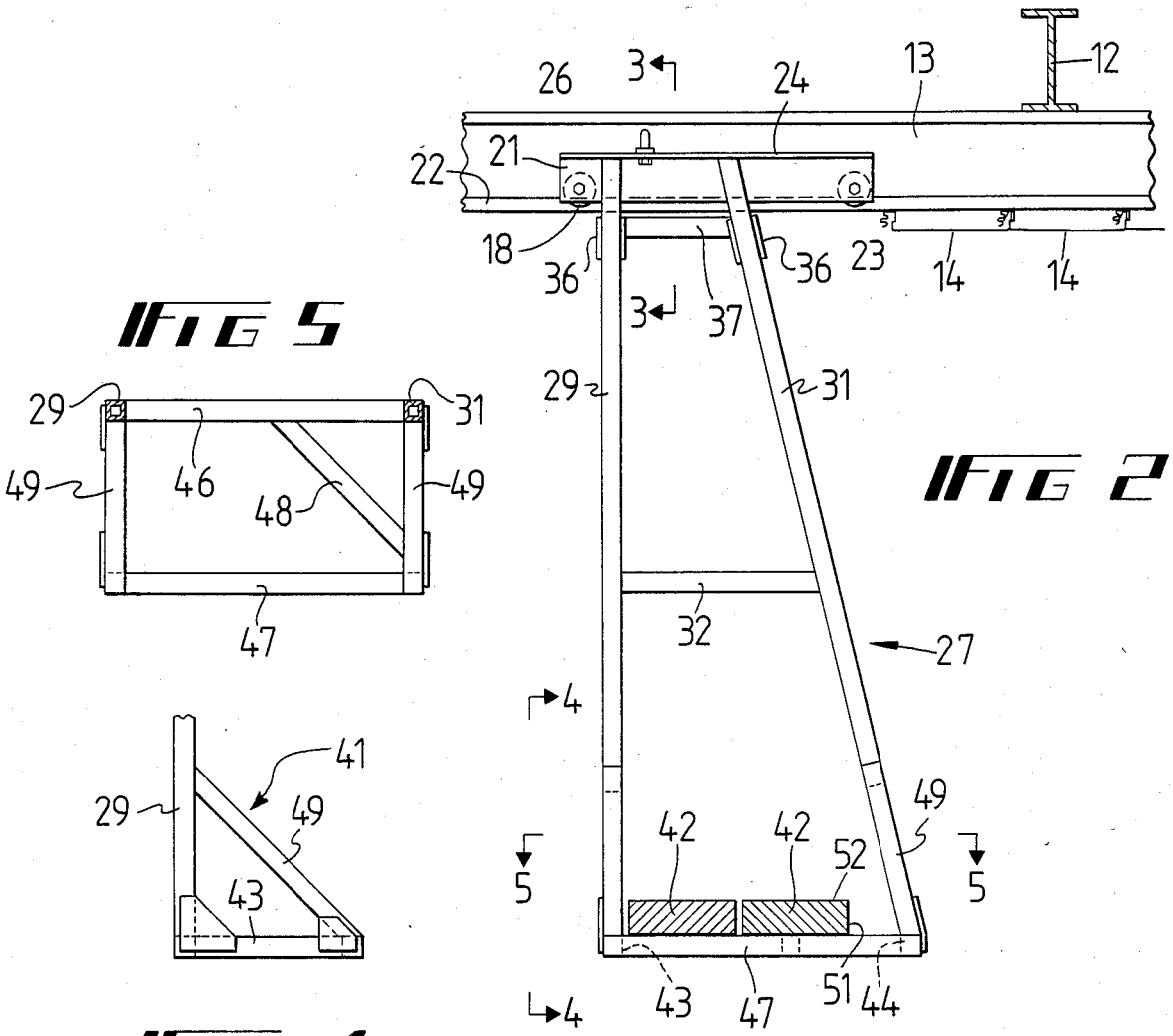
FIG 2
FIG 5
FIG 4
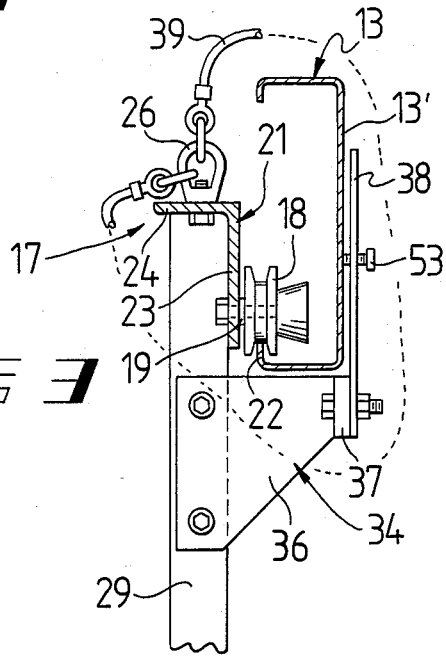
FIG 3

SUSPENDED SCAFFOLD

FIELD OF THE INVENTION

The present invention relates generally to the field of construction apparatus and more particularly to scaffolding used in construction of overhead fixtures. More particularly the present invention relates to suspended mobile scaffolding which is suspended from the same element as the overhead fixtures are to be attached to. Even more particularly the invention may be described as a suspended scaffolding for use beneath purlins for attachment of fixtures to the same.

BACKGROUND OF THE INVENTION

Construction workers and painters are oftentimes required to work at some elevation above their normal reach. Conventionally such workers have used ladders and scaffolds to extend their reach. The most common scaffolding is erected on the ground and utilizes a plurality of vertical, horizontal, and bracing elements to support a platform upon which the worker stands. When the area thus brought within the workers' reach is completed the scaffolding must be added to vertically or, more troublesomely, the entire scaffolding must be moved laterally. In either instance the workers must descend from the scaffolding to enable the placement of the platform to a new work area. Another common type of scaffolding is suspended from the top of a structure by ropes and pulleys, e.g. window washing and sign painting equipment, and provides the worker with freedom of movement in the vertical direction, but is not readily mobile in the horizontal direction.

A particular type of construction which has traditionally used scaffolding is the installation of roof panels on purlins such as are found at gas stations or other open air shelters. In this instance the workers require a stable work platform inasmuch as there is no adjacent wall to utilize for support and the workers are normally using both hands to install the roof panels overhead. Conventional suspended scaffolding as hereinabove described is not stable enough and is not readily mounted to this type structure, nor does it provide the lateral movement necessary. Ground scaffolding is cumbersome and inconvenient for this type work since it must be moved often in the course of installing a complete roof.

SUMMARY OF THE INVENTION

The present invention overcomes the disadvantages of the prior scaffolding in this specialized area by utilizing the purlins to which the roof panels are attached as support for the scaffolding. The purlins are typically C-beams which have upstanding flanges along their longitudinal dimension. The present invention utilizes these flanges as a guide rail for a plurality of circumferentially grooved rollers which carry a rigid frame that extends downwardly and provides support for a work platform. The platform is thus supported by and stabilized by the rigid frames which in turn are supported intermediate the rollers to provide a secure working platform. The workers are able to manually propel the scaffolding along the length of the purlins.

It is an object of the present invention to provide a stable, mobile platform for workers erecting overhead fixtures, such as roof panels.

Another object of the invention is to provide a work platform which may be repositioned without mechanical assistance and without dismounting therefrom.

Yet another object of the invention is to provide a stable, mobile, work platform which requires no specialized mounting accessories.

DESCRIPTION OF THE DRAWINGS

Apparatus embodying features of my invention is shown in the accompanying drawings, forming a part of this application, wherein:

FIG. 2 is a sectional view taken along the line 2—2 of FIG. 1 showing the suspension frame in relation to the purlins;

FIG. 3 is a partial sectional view showing the engagement of the scaffolding with the purlin;

FIG. 4 is a fragmental side elevational view of the platform support; and,

FIG. 5 is a plan view of the platform support with the suspension elements in section.

DESCRIPTION OF A PREFERRED EMBODIMENT

Figure 1:
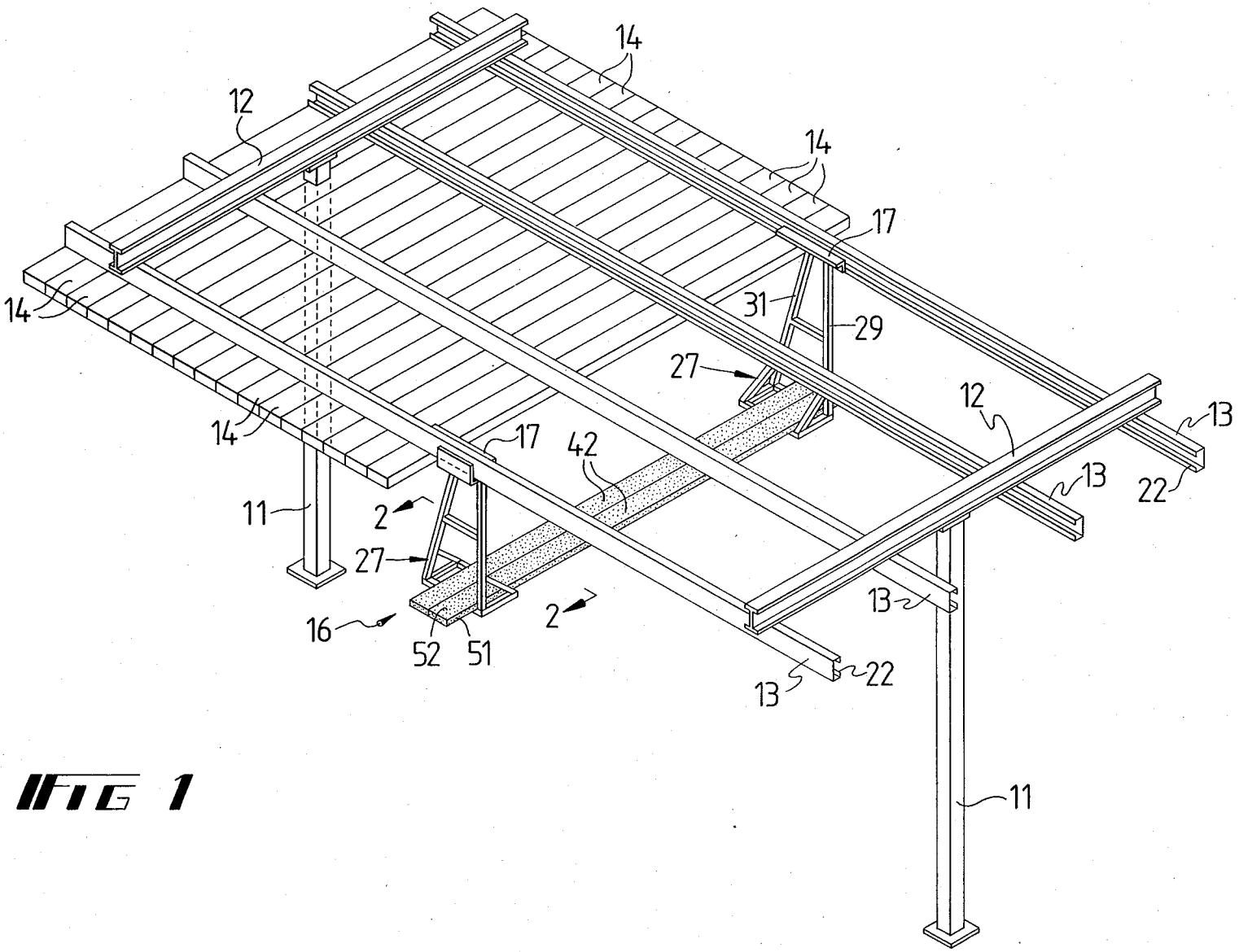
FIG. 1 is a perspective view showing the suspended scaffolding positioned beneath the purlins of a structure such as a gas island cover.

Referring to FIG. 1, there is shown an open air structure, such as a gas island cover, under construction. The structure has vertical support columns 11 which support a pair of I-beams 12 which have four purlins 13 attached thereto. Suspended from the purlins, which are in the form of C-beams, is a plurality of roof panels 14. A suspended scaffolding, shown generally at 16, is supported by the two outside purlins 13 so that construction workers may position the roof panels 14 along the length of the purlins.

The scaffolding has a carriage 17 which supports it for movement along the length of the purlins 16. The carriage 17 has a plurality of circumferentially grooved rollers 18 mounted on individual horizontal axles 19, which in turn are carried by a roller plate 21. The rollers 18 engage upturned flanges 22 on the purlins 13 whereby each flange 22 acts as a guide rail for the rollers 18. The roller plate 21 has an inverted L-shaped cross section with the vertical member 23 receiving the axles 19 for the rollers 18, as shown in FIG. 3. Its horizontal member 24 has an eyebolt 26 attached thereto for a safety purpose, as will be discussed hereinafter.

Depending from the carriage 17 is a frame 27 which has a rigid forward element 29 and a rigid rear element 31. The forward element 29 is attached vertically to the carriage 17 just behind the front rollers 18. Rear element 31 is offset rearwardly and is inclined downwardly and rearwardly from its point of connection near the center of carriage 17 to a point located rearwardly of and beneath the rear end of carriage 17. A cross member 32 connects the front element 29 and rear element 31 near their midpoints. It should be noted that the positioning of elements 29 and 31 places the gravitational force of the mass supported thereby intermediate the rollers 18 thereby preventing either roller from lifting off flange 22.

At the top of each front element 29 and rear element 31 is a retainer unit 34 which has a pair of gussets 36 attached to each side of elements 29 or 31. These gussets 36 are affixed to a mounting bar 37 which carries a retainer plate 38. The retainer plate 38 extends upright and proximal the vertical wall 13' of the purlin 13. The proximity of the retainer plate 38 to the purlin 13 and its rigid affixation to the carriage 17 prevents the rollers 18 from tipping over inwardly of the purlin 13. Also, if a roller 18 jumps off flange 22, the retainer plate 38 would inhibit inward motion of the carriage 17 so that the axle 19 could still support the scaffold 16.

A safety cable 39 is attached to eyebolt 26 and looped about purlin 13 adjacent thereto to provide an emergency support in the event an axle 19 should fail. Preferably, the workers will wear a safety line, not shown, which is clipped to cable 39.

Attached to the bottom of front element 29 and rear element 31 is an open platform support 41 which supports a plurality of platform elements 42. The platform support 41 has a pair of transverse members 43 and 44 and a pair of longitudinal members 46 and 47 which are slightly longer than is the roller plate 21. Front element 29 attaches to the forward end of longitudinal member 46 and rear element 31 attaches to the rear of longitudinal member 46. The members 43, 44, 46 and 47 form a horizontal rectangle which has an internal brace 48. A brace 49 extends from each of elements 29 and 31 to longitudinal member 47. It should be noted that the platform support 41 is on the opposite side of elements 29 and 31 from the retainer units 34 and thus extends under the platform elements 42.

The platform elements 42 are supported by the frame 27 and the platform support 41 whereby they lie on top of the platform support 41 and are thus supported at each end by the structure depending from the purlins 13. The platform elements 42 are basically planar having longitudinal vertical sides 51 and transverse horizontal sides 52 such that the longitudinal vertical sides 51 span the width of the structure whereby the platform elements 42 rest on the longitudinal members 46 and 47 and the transverse horizontal sides 52 have a total width less than the length of the longitudinal sides and they may be rotated relative to each other and/or removed from the platform support 41. The platform support 41 by the nature of its extension under the platform elements 42, provides extended support to the elements 42 rather than the narrow support offered if only member 46 were used. This extended support under the platform elements 42 causes the scaffold 16 to be more stable perpendicular to the purlins 13, thus reducing the stress placed on retainer units 34.

It is desirable to arrest the rolling motion of the scaffold 16 along its purlin 13. This is readily accomplished by a threaded machine screw 53 adjustably mounted through retainer plate 38 so that the screw may be urged against the vertical wall 13' of purlin 13.

In operation, the rollers 18 are engaged on the flanges 22 at one end of a pair of purlins 13. The platform elements 42 are inserted through the frames 27 beneath each purlin 13 so as to rest atop the platform support 41. The workers mount the platform elements 42 and are in position to attach the roof panels 14 to the purlins behind the scaffold 16. It should be noted that the angled attachment of the rear element 31 between the carriage 17 and the platform support 41 makes it possible for the worker to work nearly overhead without excessive extension of his body beyond the platform support 41.

When a column 11 is encountered one of the platform elements 42 is rotated onto its longitudinal side 51 and the scaffold is moved closer to the column 11. The rotated platform element 42 is withdrawn, passed around the column 11, and repositioned on the platform support 41. The remaining platform element 42 is handled in like manner and the worker is able to move from one platform element to the other to facilitate the transfer without descending. As the roof panels 14 are installed the scaffolding 16 is manually pulled along the length of the purlin 13.

While I have shown my invention in but one form, it will be obvious to those skilled in the art that it is not so limited, but is susceptible of various changes and modifications without departing from the spirit thereof.

What I claim is:

1. A portable suspended scaffold for use beneath a pair of spaced apart purlins comprising:

(a) independent carriage means adapted for rolling engagement with each of said purlins with said carriage means having a plurality of circumferentially grooved rollers and a roller plate, associated with each roller, carrying at least two of said rollers in rolling engagement with said purlins;

(b) suspension means depending from said carriage means beneath each of said purlins which includes a vertical frame having an upper end connected to said roller plate and extending downwardly therefrom a predetermined distance and terminating at a lower end and a platform support carried by said lower end;

(c) a plurality of platform elements extending transversely of said purlins and removably carried by said platform support which extends perpendicular to said frame beneath said platform elements; and (d) means for preventing disengagement of said carriage means from said purlin having safety means attached to said roller plate and detachably attached to said purlin and retaining means attached to said frame, with said safety means including an eyebolt extending from said roller plate and a flexible member connected to said eyebolt so as to loop about said purlin.

2. A portable suspended scaffold for use beneath a pair of spaced apart purlins comprising:

(a) independent carriage means adapted for rolling engagement with each of said purlins with said carriage means having a plurality of circumferentially grooved rollers and a roller plate, associated with each roller, carrying at least two of said rollers in rolling engagement with said purlins;

(b) suspension means depending from said carriage means beneath each of said purlins which includes a vertical frame having an upper end connected to said roller plate and extending downwardly therefrom a predetermined distance and terminating at a lower end and a platform support carried by said lower end;

(c) a plurality of platform elements extending transversely of said purlins and removably carried by said platform support which extends perpendicular to said frame beneath said platform elements;

(d) means for preventing disengagement of said carriage means from said purlin having safety means attached to said purlin and retaining means attached to said frame with said retaining means including a bracket attached to said frame adjacent said purlin having an upright plate-like member proximal the upright portion of said purlin; and (e) means for restraining said scaffold from rolling motion along said purlins including an adjustable threaded member extending through said upright plate-like member and engaging said purlin.

3. A portable suspended scaffold for use beneath a pair of spaced apart purlins comprising:

(a) independent carriage means adapted for rolling engagement with each of said purlins having a forward end and a rearward end, a plurality of circumferentially grooved rollers, and a roller plate, associated with each of said purlins, carrying at least two of said rollers in rolling engagement with said purlins;

(b) suspension means depending from said carriage means beneath each of said purlins and affixed to said roller plate such that the gravitational force exerted on the mass supported by said suspension means acts through a point intermediate said rollers carried by said roller plate, with said suspension means including a vertical member connected to said carriage means proximal said forward end and intermediate said rollers, a downwardly and rearwardly extending member connected to said carriage means proximal the center thereof and intermediate said rollers, and a horizontal platform support connected to said vertical member and said downwardly and rearwardly extending member at a predetermined distance beneath said carriage; and (c) a plurality of platform elements extending transversely of said purlins and removably carried by said suspension means, with said platform support extending beneath said platform elements to provide support thereto.

4. The scaffold defined in claim 3 wherein said platform support has a dimension parallel to said purlin at least as long as said carriage means.

5. The scaffold defined in claim 4 wherein said platform elements each have a longitudinal dimension and a transverse dimension such that the cumulative transverse dimension is less than the dimension of said platform support parallel to said purlin, said platform elements being normally co-planar and abutting along said longitudinal dimension.

* * * * *